US007540690B2

(12) United States Patent
Garcia et al.

(10) Patent No.: US 7,540,690 B2
(45) Date of Patent: Jun. 2, 2009

(54) ADJUSTABLE SIZE BUOYANCY COMPENSATOR

(75) Inventors: Martin Garcia, Torrance, CA (US); John L. Modugno, Torrance, CA (US); John L. Modugno, Jr., Torrance, CA (US)

(73) Assignee: G Albert Hreish, Huntington Beach, CA (US)

( * ) Notice: Subject to any disclaimer, the term of this patent is extended or adjusted under 35 U.S.C. 154(b) by 420 days.

(21) Appl. No.: 11/535,309

(22) Filed: Sep. 26, 2006

(65) Prior Publication Data

US 2007/0077126 A1 Apr. 5, 2007

Related U.S. Application Data

(60) Provisional application No. 60/723,618, filed on Oct. 3, 2005.

(51) Int. Cl.
*B63C 11/02* (2006.01)
*B63C 9/11* (2006.01)
*B63C 9/125* (2006.01)

(52) U.S. Cl. ..... 405/186; 405/185; 441/88

(58) Field of Classification Search ..... 405/185, 405/186; 2/69; 441/88, 92, 96, 102, 106, 441/108, 111, 114, 119
See application file for complete search history.

(56) References Cited

U.S. PATENT DOCUMENTS

| | | | |
|---|---|---|---|
| 5,346,419 | A | 9/1994 | Kaiser |
| 5,451,121 | A | 9/1995 | Seligman |
| 5,516,233 | A | 5/1996 | Courtney |
| 5,562,513 | A | 10/1996 | Kaiser |
| 5,662,433 | A | 9/1997 | Seligman |
| 5,785,567 | A | 7/1998 | Modugno |
| 5,855,454 | A | 1/1999 | Courtney et al. |
| 6,341,921 | B1 | 1/2002 | Anderson et al. |
| 6,530,725 | B1 | 3/2003 | Courtney et al. |
| 6,558,082 | B1 | 5/2003 | Courtney et al. |
| 6,881,011 | B1 | 4/2005 | Carmichael |

*Primary Examiner*—David J Bagnell
*Assistant Examiner*—Sean D Andrish
(74) *Attorney, Agent, or Firm*—Martin Garcia; G Albert Hreish

(57) ABSTRACT

A buoyancy compensator vest for providing adjustable buoyancy at various underwater depths by having a back portion for supporting an air tank and an air bladder for inflating and deflating, a portion of the air bladder of which is situated in the arms which surround the waist of the wearer. The improvement of an adjustment strap which can provide continuous variation within limits, of the reach of each of the inflatable arms of the vest whereby the girth of the vest can be continuously and uniformly adjusted to accommodate a wide range of body sizes, in particular waist sizes.

16 Claims, 4 Drawing Sheets

ADJUSTABLE SIZE BUOYANCY COMPENSATOR

This application has the benefit of Provisional Application No. 60/723,618 filed Oct. 22, 2005.

FIELD OF THE INVENTION

In the underwater diving sport/industry aka SCUBA Diving, there is a requirement for the use of a buoyancy compensating device, particularly when the diver is wearing an environmental or exposure suit, either a wetsuit or drysuit or the like and carrying one or more tanks of compressed air. Neutral buoyancy of the diver and its equipment is first obtained at sea level. After a diver descends a few feet below sea level, neutral buoyancy is lost and the diver becomes negatively buoyant due to the increase of atmospheric pressure causing compression of the diver's body, equipment and any suit or protection device he is carrying. A relatively recent development of the past few decades has been an inflatable device which serves the purpose of adjustably compensating for the weight of the diver and the diver'equipment. This equipment has as its principal purpose to permit the diver to achieve neutral buoyancy at any depth and to assist the diver to selectively achieve levels of either positive or negative buoyancy as desired. In this regard, a commonly used device has developed in the form of a vest known as a buoyancy compensation device aka a BCD which the diver wears and which is capable of inflation and deflation as desired.

DESCRIPTION OF THE PRIOR ART

At the present development of the art, a BCD is made of an elastomeric material configured in the form of a jacket or a vest which has a waist or arm portion designed to surround a diver'waist, a front portion carrying a variety of straps and attachments and a backpack portion which carries mounting equipment upon which an air tank and related equipment are affixed. The vest is composed of one or more air chambers or pockets which are inflatable compartments situated either in the front portion of the vest, the arms and/or as a bladder on the back of the vest surrounding the backpack and air tank. A typical BCD in addition to carrying the mounting plate on the backpack for the air tank, accommodates the carrying of numerous other equipment attachments, such as the first stage pressure compensator affixed to the outlet of the air tank, various air hoses and/or other communication devices to provide the diver with information concerning the conditions of his equipment, and of his dive. In addition, some BCD's carry or are provided with attachments to carry detachable lead weights to offset the positively buoyant effect of the air of the tank and the positively buoyant effect of a wetsuit. In other situations, instead of part of a BCD vest, a diver may wear a separate weight belt which consists of a belt to which are attached a number of lead weights. The BCD vest configuration also includes shoulder straps and typically a front closing waist or belt fastener for ease of securing the buoyancy compensation device and for carrying the various equipment mentioned herein.

As may be anticipated, there is a need to match body shapes and sizes to a buoyancy compensation vest. A loose fitting vest reduces performance and control by the diver. A tight fitting vest could be considered a safety hazard due to the possibility of respiratory restrictions should the vest become over inflated. It has been the custom of the industry to provide, as in the garment industry a number of size or ranges of sizes from extra small, small, medium, large, and extra large, and occasionally sizes in XXS and XXXL as well. It has long been a desire in the industry to provide a universally adjustable buoyancy compensation vest. The reasons are financial and administrative. Given the need for a properly fitting buoyancy compensator vest, it has been typical to have the numerous sizes mentioned. For the manufacturer, this presents a financial dilemma and at the consumer level causes higher costs and lower usage rates. Equipment rental shops are required to carry a wide range of sizes in order to accommodate customers and dive boat operators and dive shop suppliers likewise must carry a wide inventory of sizes to accommodate their customers. A similar scenario presents itself where friends and families wish to share and/or pass along their equipment to other members or with dive teams such as the military and Coast Guard, fire departments and search and rescue teams. The same is true for young divers who have not yet achieved full adult growth size and must either rent or sell and resell equipment of different sizes over the period of time of their body growth. In view of this stated need, a number of solutions have been proposed.

U.S. Pat. No. 5,346,419 issued to Karl Kaiser (Kaiser '419) for a buoyancy compensator device with backpack and adjustable harness. The Kaiser device is an example of many similar buoyancy compensators which have sought to solve the problem of different waist or body girth sizes by providing a form of cummerbund or waistband. Kaiser '419 discloses a torso band having two adjustable elastic connection bands which connect at their distal extremities by means of a hook and pile fastener arrangement and the posterior portions of these bands are securely fastened to the inside wall of the buoyancy compensator body by adjustable buckle devices. By adjusting the buckle connections, the length of one or both of the torso bands can be lengthened or shortened to thereby adjust the vest to accommodate the girth of the diver.

U.S. Pat. No. 5,662,433 issued to Scott P. Seligman similarly discloses a waist or girth adjustable BCD. In this reference, the waist size is incrementally adjusted by means of pins affixed to the interior of the back panel of the vest. The pins are fitted into one of several slots formed on the sides of each of the two waistbands. The two waistbands join together in the front again in a cummerbund fashion by overlapping hook and pile fasteners. In this manner, this reference teaches a degree of waist size or girth adjustment.

U.S. Pat. No. 6,881,011 issued to Robert Manuel Carmichael similarly seeks to provide for an adjustment of the waist size. This reference teaches that this adjustment can be accomplished by utilizing a three part construction consisting of two side belts that pass through a wire-loop fixture and return against the inside of the belt which is secured at its outer ends by hook and pile fastener. The back looped portion of the belt is secured and locked in place by the compression created by wearing the device.

In U.S. Pat. Nos. 5,451,121 and 5,562,513 similarly teach the provision of buoyancy compensation device having adjustable or variable adjustments for waist size by varying the length of a waistband.

Each of these designs suffer the deficiency that the methodology for providing an adjustable waist size can provide only a limited range of adjustment. This is due in significant part to the fact that these vests are made of heavy fabric and are thus somewhat bulky and inflexible. A vest well fitted to an adult male who wears, for example, a size 46 jacket, could not be made to properly fit an adult female who typically wears a size 8 dress size by employing the waistband adjustment schemes of the prior art. The range of adjustment is not sufficient. And while most of these references also teach the provision of an elastic section in the waist belt or waist band, an elastic section serves only to maintain a pre-adjusted securement to compensate for compression changes in body size as a result of the depth at which a diver is located at any one time. The elastic sections in these belts as taught by the prior art do not provide a means of adjusting the girth of the device.

In spite of the development of the devices set forth in the prior art and other similar devices, it remains a requirement of equipment providers and manufacturers to provide buoyancy compensation vests in a wide range of sizes from extra small to extra large. This is so because of the requirement for a very good fit between the diver and his buoyancy compensation vest.

It is an object of the present invention to provide a buoyancy compensation device in the form of a vest which is universally adjustable about of the waist of the diver's body and which can vary in girth or diameter from extra small to extra extra large.

It is a further object of the present invention to provide a buoyancy compensation device which is continuously variable and adjustable to accommodate the different girth sizes of a diver.

Yet a specific object of the present invention is to provide a buoyancy compensation device in which the waist can be adjusted by adjusting the size of the inflatable arms of the device.

It is a further object of the present invention to provide a buoyancy compensation device which can accommodate different body sizes of divers independently of adjustment of the waist band or cummerbund attachments typical of prior art devices.

SUMMARY OF THE INVENTION

In summary, this invention is directed to a buoyancy compensation (sometimes also called "compensator") device (BCD) having a typical shell consisting of a body portion having an inside wall and an outside wall forming an inflatable member with a typical backpack portion which includes a securing band adapted for securing an airtank to the backpack. The BCD is in the form of a vest consisting of a back portion and lateral arms which are intended to be secured at the waist of the wearer and affixed in the front in the typical manner such as by buckles, snap tabs or hook and pile fasteners. There are various ways set forth in the prior art for affixing the terminal ends of the arms together in the front of the wearer. There are two variations of the typical vest, one in which the shell of the vest is made of a heavy canvas-like material which has been impregnated with urethane so that it may be inflated and will hold air under pressure against leakage. In another basic embodiment, the shell is fitted to accommodate internal bladders formed of sealable urethane. These bladders are inserted inside the arms and/or the back portions of the vest and are communicated to a source of low pressure air for inflation. In that embodiment, it is the internal bladders which carry the air to inflate the vest rather than the shell of the vest as in the first embodiment.

The invention involves a mechanism for varying the reach of the arms by selectively collapsing the material in the arms so that when the arms are joined together in the front of the wearer, they will fit a wide range of body sizes or waist sizes. This mechanism includes a strap affixed through a intermediate pouch to an additional strap or straps inside the enclosure of the arms so that they can be pulled inwardly or let outwardly to adjust to a desired waist size. The retraction of the strap pulls the shell of the arm by applying tension on the inner surface of the shell, collapsing the material of the shell. Appropriate supporting baffles situated in the enclosure of the arms or in the bladders inserted in the enclosure of the arms, avoid lateral enlargement of the arms upon inflation. Subsequent inflation of the adjusted arms smoothes out the collapsed material of the arms and achieves a smooth adjusted size for each of the arms so that precise adjustment to each individual wearer can be achieved. This adjustment system is designed to promote a secure attachment to the wearer of the BCD and a precise adjustment of size to the particular body configuration of almost any wearer. Thus at the water' surface or at significant depths, the vest will be form fitting and comfortable for the diver.

BRIEF DESCRIPTION OF THE DRAWINGS

FIG. 3A demonstrates the intermediate pouch when the arm is in an extended position and FIG. 3B is a cross-sectional view showing the intermediate pouch when the adjustment mechanism is fully retracted.

DETAILED DESCRIPTION OF THE INVENTION

Figure 1:
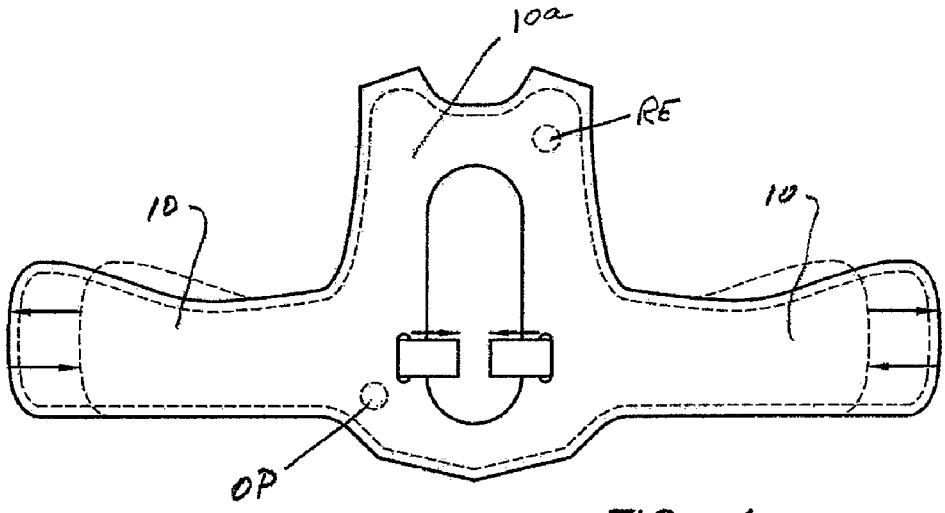
FIG. 1 is a front plan view of the buoyancy compensator device of the present invention.

FIG. 1 discloses a dive vest laid out in a planar fashion showing the arms 10 and the back portion 10*a*. This is a type of BCD which is termed "back inflatable", which also has inflatable arms. Shown in dotted lines not relevant to the present invention, are the overpressure relief valve (OP) and the entry valve (RE), which is the connection to the low pressure portion of the dive system which provides low-pressure air to inflate the vest. Relief valve (RE) is usually also a selective dump valve. Shown in dotted lines is an illustration of the range of adjustment afforded the arms, as demonstrated by the lateral arrows, indicating the relocation of the ends and/or enlargement of the arms by adjustment.

Figure 2:
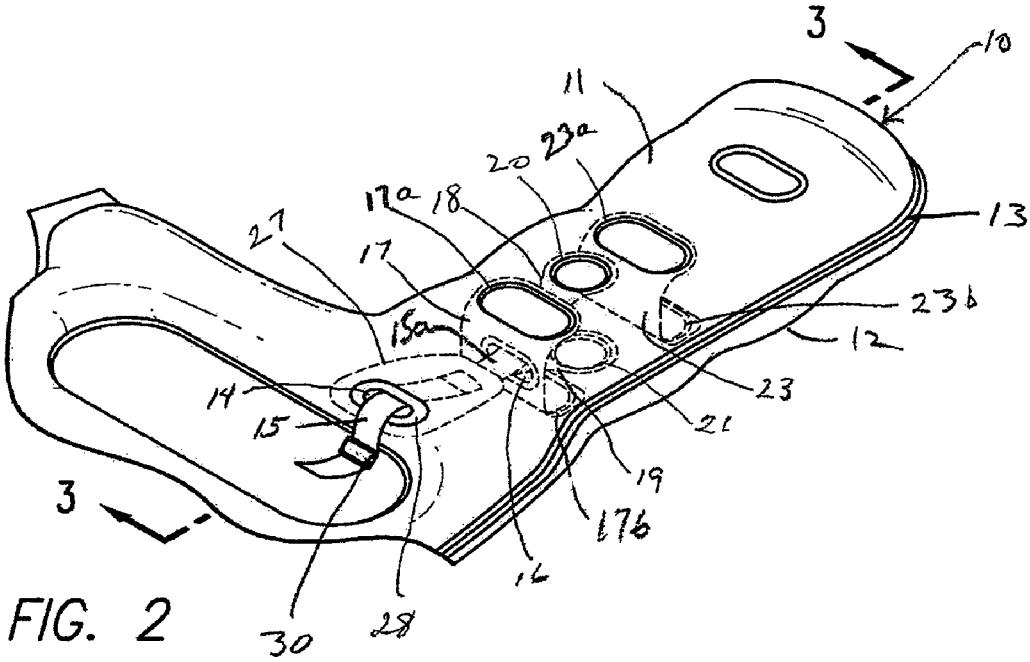
FIG. 2 is a partial perspective view of one of the arms of the buoyancy compensator device showing a first embodiment of the present invention.

FIG. 2 is a partial sectional view of one of the arms 10 showing the adjustment mechanism of a first embodiment of the present invention. In this embodiment, the shell of vest arm 10 includes upper and lower panels 11 and 12 which are sealably attached around the periphery at 13 so as to provide an airtight enclosure. As indicated by the arrows in FIG. 1, the adjustment mechanism of the present invention comprises a structure for pulling in the arms 10 in order to decrease the girth of the vest. In this regard, reference to FIG. 2 discloses in greater detail a first embodiment of a mechanism for pulling in or conversely letting out the length of the arms. This mechanism consists primarily of strap which extends from outside the shell into the enclosure of arm 10 through a first aperture 14 and through a second aperture 16 in first baffle 17. Strap 15*a* is then formed into a Y or yoke having arms 18 and 19. The extremities of arms 18 and 19 are welded to the upper panel 11 and lower panel 12 of arm 10 as indicated by the circular embossments at 20 and 21, respectively. Baffle 17 is welded in a manner well-known in the industry to the upper and lower portions of arm 10 at 17*a* and 17*b* as shown in FIG. 2. A second baffle 23 is similarly welded at upper and lower portions 23*a* and 23*b*.

Strap 15 must be accessible at the exterior of inflatable arm 10 to set the adjustment in buckle 30; however, in order to most effectively collapse the size of arm 10, strap 15 should be able to communicate with the interior enclosure of arm 10 to withdraw the upper and lower panels 11 and 12. The problem is how to do this without leaking air from the enclosure, or conversely leaking water into the enclosure. This is accomplished by the intermediate pouch 27. While a preferred embodiment of the invention employs the feature of affixing the adjustment strap in the interior of the enclosure, it is within the scope of this invention to alternatively affix the strap simply to an outer surface of the arm. It is believed that the concept of the present invention broadly encompasses the shortening of the inflatable shell portion of a vest as the means of obtaining a broad range of adjustment of the girth, as distinguished from the waistband approach. While an exteriorly mounted strap can accomplish this goal, a strap located on the outside of the shell of the vest may become snagged or entangled with other parts of the divers gear. For this and for cosmetic reasons, it is preferred that the strap be affixed inside the enclosure.

Figure 3A:
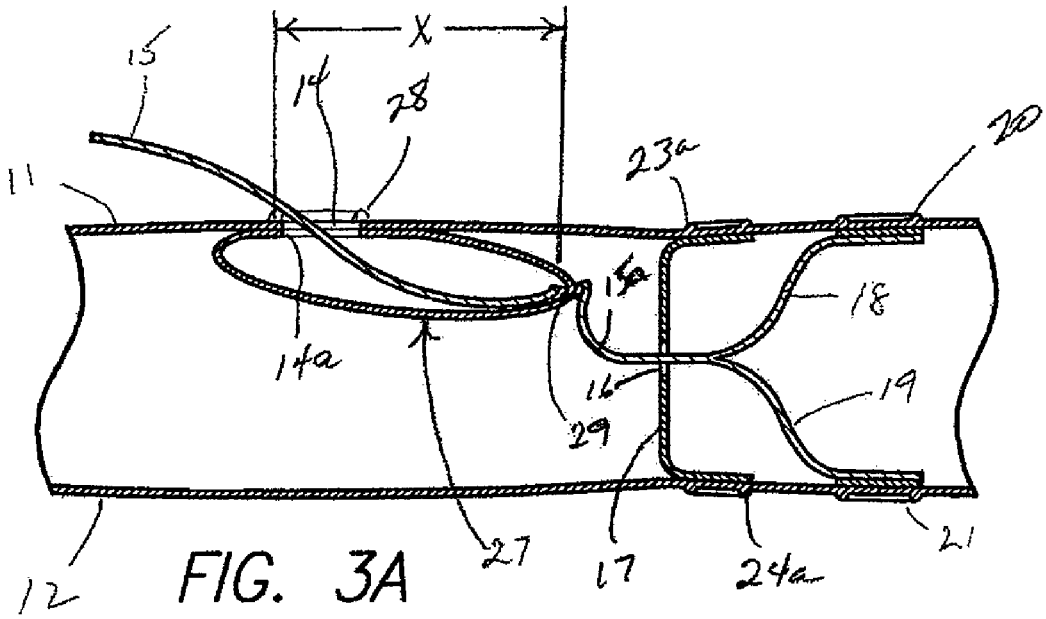
FIGS. 3A and 3B are partial sectional views taken along line 3-3 of FIG. 2.

FIG. 3A shows a sectional representation of the adjustable BCD and, in particular, shows greater detail of the intermediate pouch 27. Pouch 27 has an aperture 14*a*, which is welded to aperture 14 of top panel 11. Pouch 27 is thus totally situated within the enclosure of the shell and, while aperture 14 is open to the outside atmosphere, pouch 27 is entirely sealed and in communication with the interior enclosure of arm 10. Adjustment strap 15 extends through apertures 14 and 14*a*. Adjustment strap 15 extends to the distal end of pouch 27 and is weldably fixed thereto at point 29. Point 29 is in turn weldably affixed to an extension of strap 15, i.e., strap 15*a*, which extends through aperture 16 and then is divided into upper and lower yoke members 18 and 19, which are respectively affixed by appropriate weldments 20 and 21 to the upper and lower surfaces of the arm 10, specifically, the under-surfaces of panels 11 and 12, respectively.

Figure 3B:
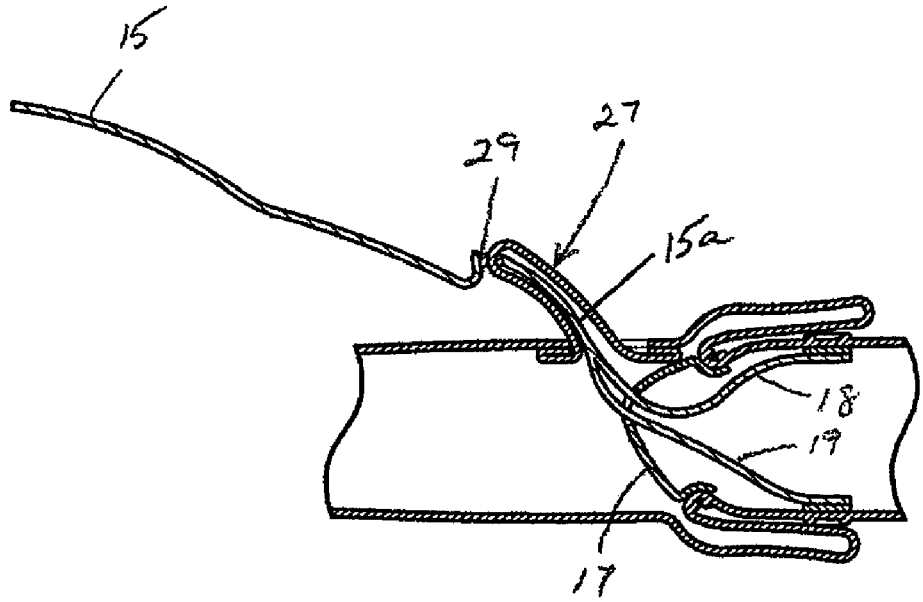

FIGS. 3A and 3B provide a graphic representation of further features of the pouch 27 shown in FIG. 2. The intermediate pouch 27 is made of quite flexible material. It is shown in FIG. 3A with the arm 10 in its most extended position. Reduction of the length of arm 10 from its most extended position is accomplished by pulling strap 15 to the left and fixing it with the buckle 30. As strap 15 is pulled inwardly, the intermediate pouch 27 is pulled inwardly as well and collapses without compromising the sealed integrity of the interior enclosure of arm 10. As strap 15 is pulled more and more inwardly, the weldment section 29 on pouch 27 can be pulled through apertures 14, 14*a* so as to achieve the maximum withdrawal and therefore foreshortening of arm 10. It is contemplated that the range of movement of strap 15 from its outermost extension to its innermost withdrawal can be on the order of about twice the dimension between aperture 14 and weldment 29, indicated at "X" in FIG. 3A. If, for example, the pouch were constructed such that dimension "X" were six (6) inches, adjustment of arm 10 could achieve a range of about twelve (12) inches.

Figure 4:
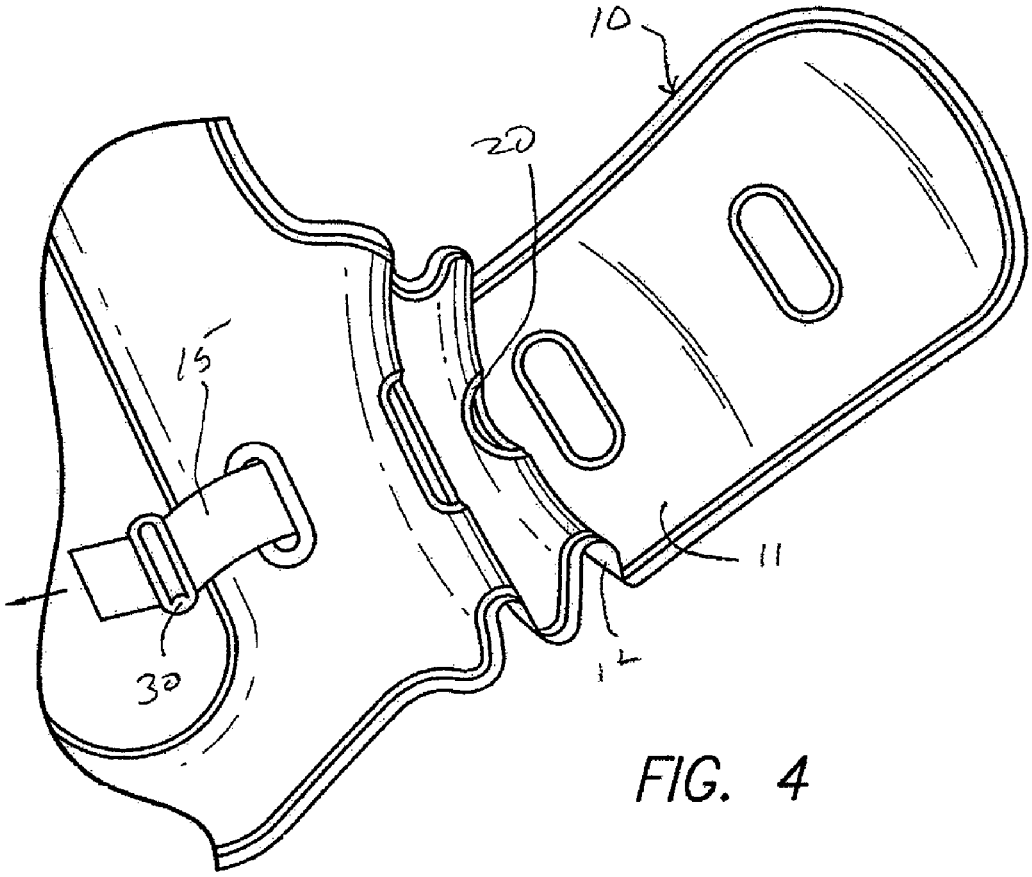
FIG. 4 is a partial perspective view of an arm of the BCD in a retracted configuration prior to inflation thereof.
Figure 5:
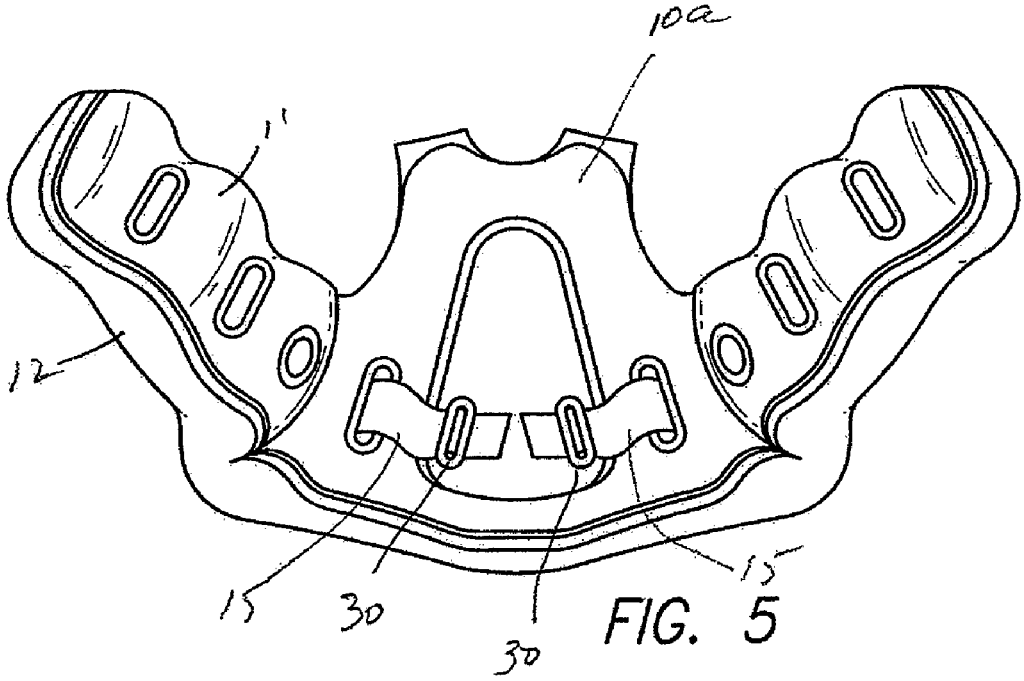
FIG. 5 is a perspective plan view of the buoyancy compensator device of the present invention after the arms have been retracted and the vest has been inflated.

Referring now to FIG. 4, it will be seen that upon a substantial withdrawal of strap 15, the material of arm 10 becomes folded or crumpled in a seemingly unsuitable fashion in that, in particular, the area between the points of affixation of strap 15*a* at weldment 20 collapses as strap 15 is pulled to the left, and even more so if weldment 29 is pulled through aperture 14. It would thereupon seem that the inflatability of the adjusted vest is compromised; inasmuch as there is now a bulk of material still a part of arm 10 that has been foreshortened, collapsed and, accordingly, of questionable inflatable utility. However, because the arm and back portion of the BCD are an integral inflatable structure, the collapse of the material in arm 10 permits that material upon inflation to move into the back portion of the vest. The width of the arms do not increase laterally because baffles 17 and 22 limit lateral expansion of arm 10, and further assist in urging the collapsed materials of arm 10 to migrate to other areas of the shell. FIG. 5 shows a fully inflated vest with the adjustment straps of both arms fully withdrawn to shorten the arms to the minimum. The vest fully inflates and the arms and the collapsed material are fully extended without increasing the width or diameter of the arms. The material of the foreshortened portions of panels 11 and 12 has moved elsewhere into the back portion of the vest so that when the vest is fully inflated, the arms as shown in FIG. 5 fully and smoothly inflate to form a competent and comfortable buoyancy control device.

It is in particularly preferred embodiment of this invention to employ the features of the intermediate pouch 27 which comprises the means of communication between the interior of the inflated enclosure of arm 10 and the exterior or atmospheric side of the device. This collapsible pouch of material allows strap 15 to be fully withdrawn inwardly towards the posterior of the BCD until the strap 15 may be pulled through to the full extent of the length of the pouch. By this means, it is possible to construct an adult size BCD having a continuously variable waist size from what is commonly called in the garment industry as extra, extra large (XXXL) to extra small (XS). This permits a change in girth from typically 48" to approximately 26" in circumference. This is facilitated by the extreme flexibility of intermediate pouch 27 which can extend all the way from the position shown in FIG. 3A until it is pulled through aperture 14 for maximum withdrawal as shown in FIG. 3B.

Second Embodiment of the Present Invention

Figure 6:
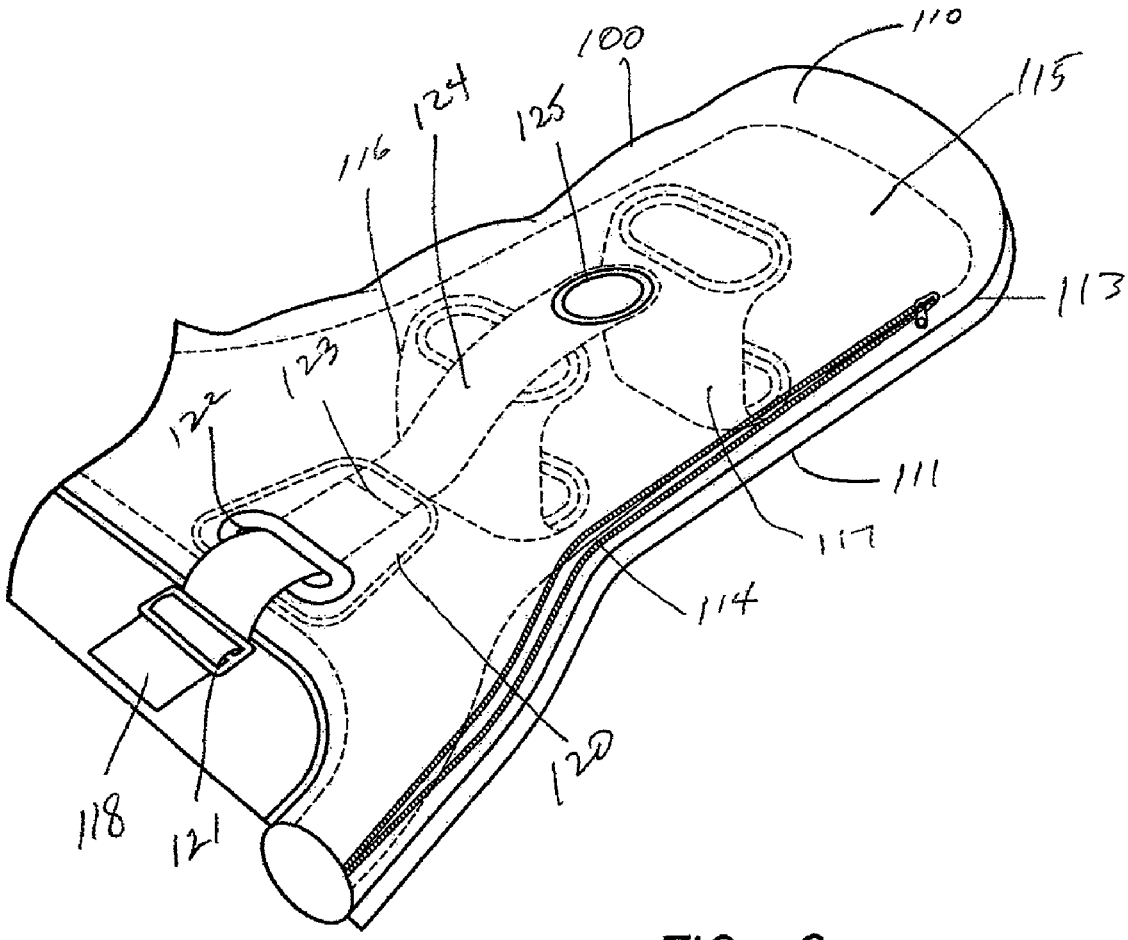
FIG. 6 is a partial perspective view of the buoyancy compensator device employing features of the second embodiment of the present invention.

The second embodiment of the present invention accommodates the type of BCD vest wherein the shell does not provide the inflatable air retention pockets of the device, but rather separate bladders made of air impervious urethane material is used as the air container of the first instance. In this configuration, the material of the shell can be a lighter weight material, but may also be impregnated with urethane material so as to provide a secondary protection against leakage, if desired. FIG. 6 shows the present invention adapted to a dual bladder, or inner bladder version of BCD. Here arm 100 has upper and lower panels 110 and 111 sealably attached at the edges 113 to form an enclosure. This arm 100 is provided with zipper 114 to provide access to the interior of arm 100 for the insertion of bladder 115. Bladder 115 is provided with interior baffles 116 and 117, which limit lateral expansion of the bladder upon inflation similar to the function of baffles 17 and 22 in the single bladder embodiment. In the double bladder configuration, the retraction system is similar, in that an intermediate pouch 120 is employed, substantially like pouch 27 of the first embodiment. The adjustment strap 118 is coupled at one end to buckle 121 and extends through aperture 122 into the interior enclosure of pouch 120. At the distal end of pouch 120, strap 118 is welded at 123. Another portion 124 of the adjustment strap is fixed in similar manner to an outer portion of pouch 120 immediately adjacent weldment 123 at the distal end of pouch 120. In this embodiment, strap 124 extends into the enclosure, over the bladder 115 to an intermediate portion of the upper panel 110 of arm 100 and is welded to the interior panel as shown at weldment 125. While FIG. 6 shows strap 124 attached to the upper panel 110, it is equally contemplated to attach it to the lower portion 111 of arm 100. Similarly, as related in the description of the single bladder version, it is contemplated that the strap here could be simply attached to an outside surface of the arm and accomplish the purpose of shortening the arm; however, as stated, this may not work as efficiently as the interior attachment. Furthermore, the cosmetics are not as aesthetically pleasing, and an exterior strap could become snared or entangled by the divers other equipment, and thus is not such an efficacious design as the interior attachment regime.

In this embodiment, strap 118 functions in a similar way to that of strap 15 in that retracting or moving strap 118 to the left (in FIG. 6) pulls strap 124 to the left, pulling weldment 125 towards aperture 122. Similar to what is shown in FIG. 3B, full retraction of the adjusting strap contemplates pulling the distal end of pouch 120 through its own aperture 122. Full retraction of the adjustment strap 118 in the dual bladder version can be accomplished in a manner similar to that shown in FIG. 3B. Hence, in use, obviously prior to the full inflation of bladder 115, strap 118 may be adjusted and held in place by buckle 121 while the continuous retraction of strap 118 achieves the proper waist adjustment for the vest.

It is contemplated that elastic portions in straps 118 or 15 may also be employed to permit slight size variations in the pre-adjusted sizing of the arms. Elastic portions accommodate changes in body size due to compression. The vest maintains the pre-adjusted sizing accomplished prior to immersion in the water, thereby accommodating changes in the body of the diver and of his equipment at greater depths below sea level, while maintaining the same pre-fit and adjusted sizing of the vest made prior to diving. This maintains a good fit of the vest on the diver throughout the dive.

The second embodiment can thus provide in a manner similar to that of the first embodiment a means of adjusting the size of the arm 100 so as to accommodate a range of sizes continuously adjustable from a very small waist size typically of about 26 inches in diameter to approximately 48 inches in circumference or more. The range of adjustment provided strap 118 can provide a continuous and finely adjustable variation for the size of arm 10 to accommodate sizes anywhere from extra, extra large to extra small, speaking of garment sizes, so that the buoyancy compensator device may be worn by different people of substantially different size and shape and yet provide a proper and snug fit that is neither too loose nor too tight.

While particular embodiments and preferred designs have been shown and described herein, it is contemplated that various modifications and/or variations of the invention are contemplated and can be resorted to by those skilled in the art without departing from the spirit and scope of the invention which is defined by the following claims.

The invention claimed is:

1. A buoyancy compensator device comprising:

a back portion and a pair of lateral arms;

each of said arms comprising an upper panel and a lower panel, said upper and lower panels joined to form an enclosure, said enclosure capable of retaining a quantity of air:

the upper panel having a first aperture communicating the exterior to the interior of said enclosure, a pouch situated in a first position in the interior of said enclosure, said pouch having an aperture, said first aperture of said upper panel and said aperture of said pouch being sealably affixed about their respective peripheries, a first strap having one end at the exterior of said enclosure, said first strap extending through said first aperture into said pouch, said strap having a portion affixed to a distal end in said pouch, a second strap in said enclosure having a portion affixed to the distal end of said pouch and another portion affixed to an inner surface of one of said upper or lower panels of said enclosure.

2. A buoyancy compensator device of the type set forth in claim 1 the combination further including:

said second strap having a first end affixed to the distal end of said pouch is further divided into upper and lower strap segments, the upper strap segment being affixed to the upper panel of said enclosure, the lower strap segment being affixed to the lower panel of said enclosure.

3. A buoyancy compensator device of the type set forth in claim 1 or 2 the combination further including:

at least one baffle situated within said enclosure of each of said arms, said baffle affixed between said upper panel and said lower panel; said at least one baffle having a central passage; said second strap extending from the distal end of said pouch through said central passage of said baffle intermediate the location at which said second strap is affixed to one of said upper or lower panels.

4. A buoyancy compensator device of the type set forth in claim 1 wherein said enclosure of each of said arms further includes an internal bladder.

5. A buoyancy compensator device of the type set forth in claim 1, wherein the enclosures of each of said arms includes an internal bladder, said second strap in said enclosure having one end affixed to the distal end of said pouch, a second end of said second strap extending over said internal bladder and affixed to one of the upper or lower panels of said arm.

6. A buoyancy compensator device of the type set forth in claim 4 or 5 wherein said internal bladder has at least one baffle affixed therein which extends in a direction generally perpendicular to the upper and lower panels of said arms.

7. In a buoyancy compensator device of the type having a back portion and a pair of lateral arms, the back-portion including an air-inflatable bladder, the lateral arms including air inflatable enclosures in air communication with said back-portion bladder, the improvement comprising:

in said lateral arms an enclosure aperture in said air-inflatable enclosure, a pouch situated inside said enclosure, said pouch having an aperture, said pouch aperture sealably affixed to said enclosure aperture, an adjustment strap extending into said enclosure through said enclosure aperture and said pouch aperture, a first end of said strap affixed to an interior portion of said pouch;

a second strap situated within said enclosure, a first end of said second strap being affixed to an exterior portion of said pouch, a second end of said second strap affixed to an interior surface of a panel in said enclosure.

8. In a buoyancy compensator device of the type having a back portion and a pair of lateral arms, the back portion including an air-inflatable bladder, each of said lateral arms including upper and lower panels defining an enclosure, the improvement comprising:

an aperture in said upper panel of said enclosure, a pouch situated inside said enclosure, said pouch having a single opening sealably affixed to said aperture, said pouch further having a distal end spaced from the opening thereof, an adjustment strap extending through said aperture and into said pouch, an end of said strap affixed at the distal end of said pouch; and a second strap situated inside said enclosure, said second strap having a first end affixed to the distal end of said pouch, said second strap having another end affixed to one of said upper or said lower panels of said enclosure.

9. A buoyancy compensator device of the type set forth in claims 7 or 8 the combination further including:

said second strap having the first end affixed to the distal end of said pouch being further divided into upper and lower strap segments, the upper strap segment being affixed to the upper panel of said enclosure, the lower strap segment being affixed to the lower panel of said enclosure.

10. A buoyancy compensator device if the type set forth in claim 9 the combination further including:

at least one baffle situated within said enclosure of each said arms, said baffle affixed between said upper panel and said lower panel;

said at least one baffle having a central passage; said second strap extending from the distal end of said pouch through said central passage of said baffle intermediate the location at which said second strap is affixed to said upper and lower panels.

11. A buoyancy compensator device of the type set forth in claim 8 wherein said enclosure of each of said arms further includes an internal bladder.

12. A buoyancy compensator device of the type set for the in claim 11, wherein the enclosures of each of said arms includes said internal bladder said second strap in said enclosure having one end affixed to the distal end of said pouch, a second end of said second strap extending over said internal bladder and affixed to one of the panels of said arm.

13. A buoyancy compensator device of the type set forth in claim 5 or 11 wherein said internal bladder has at least one baffle affixed therein which extends in a direction generally perpendicular to the upper and lower panels of said arms.

14. A buoyancy compensator device of the type set forth in claims 1, 4, 7, 8 or 11 wherein the pouch is composed of an air impervious material, and wherein said material is flexible.

15. A buoyancy compensator device of the type set forth in claim 14 wherein the flexibility of the material of said pouch is sufficient to permit the distal end of said pouch to be pulled by said first strap through said apertures to the exterior of said enclosure.

16. A buoyancy compensator device of the type set forth in claims 1, 4, 8, or 11 wherein pulling said first strap inward toward said back portion is operative to move the distal end of said pouch toward said apertures, thereby pulling on one of said upper or lower panels of said enclosure to foreshorten the arm of said device.

* * * * *